United States Patent [19]

Coleman et al.

[11] 4,187,156

[45] Feb. 5, 1980

[54] PREPARATION OF DIHYDROAROMATIC HYDROCARBONS

[75] Inventors: James P. Coleman, Maryland Heights; John H. Wagenknecht, Kirchwood, both of Mo.

[73] Assignee: Monsanto Company, St. Louis, Mo.

[21] Appl. No.: 862,719

[22] Filed: Dec. 21, 1977

[51] Int. Cl.[2] ..... C25B 3/04

[52] U.S. Cl. ..... 204/73 R

[58] Field of Search ..... 204/73 R, 59 R

[56] References Cited

U.S. PATENT DOCUMENTS

| | | | |
|---|---|---|---|
| 3,682,791 | 8/1972 | Matthews | 204/73 R X |
| 3,682,794 | 8/1972 | Matthews | 204/73 R |
| 3,684,669 | 8/1972 | Matthews | 204/73 R |
| 3,699,020 | 10/1972 | Connolly et al. | 204/73 R |
| 3,700,572 | 10/1972 | Hatayama et al. | 204/73 R |

*Primary Examiner*—G. L. Kaplan

*Attorney, Agent, or Firm*—Wendell W. Brooks; James W. Williams, Jr.; Joseph D. Kennedy

[57] ABSTRACT

Electrolytic reduction at the cathode of aromatic hydrocarbons in an aqueous emulsive electrolysis medium in an undivided electrolytic cell yields dihydroaromatic hydrocarbons.

10 Claims, No Drawings

PREPARATION OF DIHYDROAROMATIC HYDROCARBONS

BACKGROUND OF THE INVENTION

This invention relates to a process for the preparation of dihydroaromatic hydrocarbons. More particularly, this invention relates to the electrolytic reduction at the cathode of aromatic hydrocarbons in an aqueous emulsive electrolysis medium in an undivided electrolytic cell to yield the corresponding dihydroaromatic hydrocarbons.

The electrolytic reduction of aromatic hydrocarbons to the corresponding dihydroaromatic hydrocarbons is known in the art. As known processes for effecting this transformation, there are exemplified the following:

(1) A method for electrolytically reducing aromatic hydrocarbons to the corresponding dihydroaromatic hydrocarbons in a divided electrolytic cell by subjecting an organic solvent free catholyte composed of a heterogeneous mixture of such aromatic hydrocarbon and an aqueous solution of one or more quaternary ammonium salts to electrolysis at a temperature from 30° C. to 100° C. This process is described in Hatayama et al, U.S. Pat. No. 3,700,572.

(2) A process for electrochemically reducing aromatic compounds in the presence of an aqueous system containing an amine, an inorganic acid or the ammonium salt thereof, and an electron deficient compound soluble in the amine, such as boron trifluoride, preferably in an undivided electrolytic cell to yield the corresponding dihydroaromatic hydrocarbon, this process being described in Matthews, U.S. Pat. No. 3,684,669.

(3) A process as described in Matthews, U.S. Pat. No. 3,682,791 for electrochemically reducing aromatic compounds in the presence of a substantially anhydrous system containing an amine, an inorganic acid or the ammonium salt thereof, and an electron deficient compound soluble in the amine, such as boron trifluoride, preferably in an undivided electrolytic cell.

(4) A process for electrochemically reducing aromatic compounds in the presence of an amine, an inorganic acid or ammonium salt thereof, and a hydrophobic quaternary ammonium salt, which process is disclosed in Matthews, U.S. Pat. No. 3,682,794.

(5) A process for electrochemically reducing aromatic compounds in the presence of anhydrous methylamine (and other low molecular weight amines such as ethylamine, ethylenediamine, or the like) containing lithium chloride in an undivided cell to yield the corresponding dihydroaromatic compounds, which process is described in Benkeser et al, *Journal of the Amerian Chemical Society*, 86, 5272–5276 (1964).

These and other prior art processes, however, have various drawbacks, such as requiring divided electrolytic cells, complex electrolysis media, anhydrous conditions, or some combination thereof, none of which are conductive to economical commercial development.

Thus the present process, whereby the electrolytic reduction of aromatic hydrocarbons to yield dihydroaromatic hydrocarbons is effected in a simplified and aqueous emulsive electrolysis medium in an undivided electrolytic cell, is a decided and useful advance in the state of the art.

SUMMARY OF THE INVENTION

This invention involves a process for the preparation of dihydroaromatic hydrocarbons by electrolytic reduction of aromatic hydrocarbons. The process comprises electrolytic reduction at the cathode by passing a direct electric current through an aqueous emulsive electrolysis medium comprising an aromatic hydrocarbon selected from the group consisting of benzene, biphenyl, naphthalene, and alkyl derivatives thereof have 1 to 4 carbon atoms and an aqueous solution of a quaternary ammonium hydroxide in an undivided electrolytic cell to yield the dihydroaromatic hydrocarbon.

The dihydroaromatic hydrocarbon products obtained in the present process can be easily recovered by separating the hydrocarbon layer from the aqueous layer and purified, if desired, by conventional procedures, for example, fractional distillation for liquids or recrystallization for solids.

DETAILED DESCRIPTION OF THE INVENTION

Electrolytic reduction of aromatic hydrocarbons in an aqueous emulsive electrolysis medium in an undivided electrolytic cell yields dihydroaromatic hydrocarbons.

In accordance with the present process, a direct electric current is passed through an aqueous emulsive electrolysis medium comprising an aromatic hydrocarbon selected from the group consisting of benzene, biphenyl, naphthalene, and alkyl derivatives thereof having 1 to 4 carbon atoms, and an aqueous solution of a quaternary ammonium hydroxide in an undivided electrolytic cell to yield the corresponding dihydroaromatic hydrocarbon.

The "aqueous emulsive electrolysis medium" employed herein is a heterogeneous mixture of an aqueous solution of the quaternary ammonium hydroxide and the aromatic hydrocarbon subjected to vigorous agitation in the undivided electrolytic cell to form an emulsion.

The term "emulsion" is employed in its usual recognized sense of a fluid consisting of a microscopically heterogeneous mixture of two normally immiscible liquid phases, in which one liquid forms minute droplets suspended in the other liquid.

Exemplary of the aromatic hydrocarbons which may be employed in the present process are benzene, biphenyl, naphthalene, and alkyl derivatives thereof having 1 to 4 carbon atoms such as toluene, ethylbenzene, n-propylbenzene, isopropylbenzene, n-butylbenzene, isobutylbenzene, t-butylbenzene, o-xylene, m-xylene, p-xylene, 4-isopropyltoluene (p-cymene), o-diethylbenzene, m-diethylbenzene, 2-methylbiphenyl, 3-methylbiphenyl, 4-methylbiphenyl, 2-isopropylbiphenyl, 2,2'-dimethylbiphenyl, 2,3'-dimethylbiphenyl 2-methyl-3'-ethylbiphenyl, 2-methyl-3'-isopropylbiphenyl, 1-methylnaphthalene, 1-ethylnaphthalene, 1-isopropylnaphthalene, 1-n-butylnaphthalene, and the like.

In carrying out the present process, an aromatic hydrocarbon selected from among those described hereinabove is charged to an undivided electrolytic cell fitted with a cathode and an anode, and an electromotive force is impressed upon the cell whereby the aromatic hydrocarbon undergoes electrolytic reduction to yield the corresponding dihydroaromatic hydrocarbon. The reaction involved can be illustrated using benzene as an example.

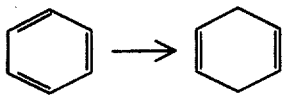

The electrolysis is carried out in the absence of ammonia, amines, various electron deficient compounds commonly employed as catalysts—boron trifluoride, aluminum chloride, aluminum bromide, tetracyanoethylene, for example—in an aqueous emulsive electrolysis medium comprising the aromatic hydrocarbon and an aqueous solution of a quaternary ammonium hydroxide. This medium, which is greatly simplified over the media of the prior art, permits the reduction to occur at the cathode with a minimum of interference by side reactions, for example, reoxidation at the anode, isomerization and further reduction to the tetrahydroaromatic hydrocarbon, and the like.

In an exemplary method of conducting the present process, a mixture of the aromatic hydrocarbon and an aqueous solution of tetra-n-butylammonium hydroxide having a concentration between about 5 percent and about 50 percent, usually between about 10 percent and about 30 percent, is charged to an undivided electrolytic cell maintained at a temperature between about 50° C. and about 85° C. and having a mercury, zinc, lead, or cadmium cathode and a nickel, stainless steel, or a de Nora-type dimensionally stable anode. The concentration of the tetra-n-butylammonium hydroxide (or in general the quaternary ammonium hydroxide) is advantageously between about 10 percent and about 30 percent in that the current efficiency is maintained at a high level even at increased percent conversion of the aromatic hydrocarbon. At lower concentrations, the current efficiency, while initially high, tends to decrease as the percent conversion increases. Higher concentrations, of course, do not suffer from this disadvantage; however, no particular advantage is gained by employing such higher concentrations.

The aromatic hydrocarbon and the aqueous solution of the tetra-n-butylammonium hydroxide (or in general, the quaternary ammonium hydroxide) is advantageously employed in a weight ratio such that the molar ratio of the aromatic hydrocarbon to the tetra-n-butylammonium hydroxide is initially between about 1:1 and about 10:1. A weight ratio sufficient to establish the molar ratio ratio initially between about 2:1 and about 5:1, plus about a 10 percent excess of the aromatic hydrocarbon is generally preferred.

Following the charging of the mixture to the undivided electrolytic cell, the mixture is vigorously agitated to form a fairly homogeneous dispersion—that is, the aqueous emulsive electrolysis medium—and a direct electric current is then impressed on the cell by connecting the cathode and anode to a proper source of direct current with controls to maintain the current density between about 0.05 and 10 or more amperes per square centimeter for a time sufficient to cause the desired reduction of the aromatic hydrocarbon to the corresponding dihydroaromatic hydrocarbon, which then is isolated as described hereinbelow.

The aqueous emulsive electrolysis medium employed in the present process will be basic due to the presence of the quaternary ammonium hydroxide and no particular provisions are necessary to regulate this parameter. However, as the reaction proceeds, carboxylic acids, for example, acetic acid, propanoic acid, butanoic acid, and pentanoic acid, various other compounds, including N-butylacetamide (when tetra-n-butylammonium hydroxide is employed as the quaternary ammonium hydroxide), cyclohexanediol, plus smaller amounts of unidentified components are produced at the anode. The carboxylic acids gradually lower the pH by reaction with the quaternary ammonium hydroxide to form carboxylates. This phenomenon results in an undesirable reduction in the current efficiency which, as noted hereinabove, occurs even more readily when low concentrations of quaternary ammonium hydroxide are employed. Thus, in long term and/or continuous operations, it may be described to remove the carboxylates from the electrolysis medium by ion exchange (alkaline or basic) or electrodialysis in order to maintain the high hydroxide ion concentration. This is accomplished by exchanging hydroxide ions for the carboxylate ions (alkaline or basic ion exchange) or by generating replacement hydroxide ions for the carboxylate ions being removed (electrodialysis). As a result, the concentration of the quaternary ammonium hydroxide is maintained and the undesired reduction in current efficiency is prevented.

It will be noted that periodic or continued addition of quaternary ammonium hydroxide to the aqueous emulsive electrolysis medium in order to maintain the concentration thereof may be employed to a limited extent. However, such a means for maintaining the concentration is generally unsatisfactory, particularly in long-term and/or continuous operations. The continued addition of quaternary ammonium hydroxide ultimately overwhelms the system. This occurs, in part at least, because the additions cause an increase in volume of the medium which ultimately exceeds the capacity of the reaction vessel. Such an occurrence, of necessity requires expensive and time-consuming equipment shutdowns in order to correct the problem. These difficulties however, are avoided by the means noted hereinabove wherein the hydroxide ions are simply replenished while simultaneously removing the carboxylate ions.

As noted hereinabove, the aqueous emulsive electrolysis medium is a fairly homogeneous dispersion. That is, the non-aqueous phase (the aromatic hydrocarbon) is dispersed relatively uniformly throughout the aqueous phase (the aqueous solution of the quaternary ammonium hydroxide). The mixing or dispersal can be carried out in any conventional manner such as by flow mixers, jet mixers, injectors, turbulence mixers, circulating mixer systems, centrifugal pumps, and the like; by paddle and propeller mixers of various designs as well as by turbine or centrifugal impeller mixers, colloid mills, and homogenizers.

The temperature at which the process of the present invention is conducted is not narrowly critical and can range from as low as about 20° C. to as high as about 100° C. or even higher if a pressure cell is employed, with temperatures between about 50° C. and about 85° C. being generally preferred. It will be recognized, however, that in order to facilitate the relatively uniform dispersal of the aromatic hydrocarbon in the aqueous solution of the quaternary ammonium hydroxide, the aromatic hydrocarbon is advantageously a liquid at process temperatures. Thus the actual temperature employed will depend to a certain extent upon the melting point of the aromatic hydrocarbon, and is advantageously equal to or greater than the melting point of the aromatic hydrocarbon utilized.

The process of the present invention can be conducted at atmospheric pressure, super atmospheric pressures, and subatmospheric pressure. For reasons of economy and ease of construction of the equipment employed in the present process, it is preferred to conduct this process at atmospheric pressure. It will be recognized, however, that super atmospheric pressures may be advantageously employed for conducting reactions at higher temperatures, for example, greater than 100° C., when the aromatic hydrocarbon has a melting point greater than 100° C. The employment of super atmospheric pressures under such circumstances facilitates the attainment of temperatures sufficiently high to assure the conversion of such solid aromatic hydrocarbons to the desired liquid state under process conditions.

The current densities employed in the process of the present invention can range from as low as 0.01 ampere per square centimeter to 10 or 100 or more amperes per square centimeter of cathode surface area. However, as noted hereinabove, the range between about 0.05 amperes per square centimeter and about 10 amperes per square centimeter is generally preferred.

The type of electrolytic cell employed in the process of the instant invention is not critical. The cell can consist of a container made of material capable of resisting action of electrolytes, for example, glass or plastic, and having one or more cathodes and anodes connected to a source of direct electric current such as a battery and the like. For purposes of adjusting and maintaining the temperature as desired, the cell can be equipped with any number of thermostating devices known to the art. For example, the cell can be placed in a thermostated bath, jacketed to take a circulated thermostated liquid, wrapped in heating cord or tape, or the like. In general, the temperature controlling methods described in Tomilov et al, *Electrochemistry of Organic Compounds*, John Wiley & Sons, Inc. (Halsted Press Division), New York, 1972, pp. 95–109 may be employed.

The electrodes, that is, the cathode and anode employed in the process of the present invention can be constructed of a wide variety of conductive materials. However, cathode materials suitable for use in the present process are preferably high hydrogen overvoltage materials, including for example, mercury, zinc, lead, cadmium, and the like. Mercury-coated surfaces of metals such as lead, nickel, gold, silver, and platinum are also suitable.

Of these cathode materials, mercury is most preferred because, in addition to the usual advantage of uniformity and smoothness of its surface, it minimizes side reactions and attendant by-product formation. Also, an increased yield of the desired dihydroaromatic hydrocarbon product is generally realized when mercury is employed as the cathode.

The anodes are constructed of conductive materials which are both relatively stable under reaction conditions employed, and cause very little, if any, reoxidation of the dihydroaromatic hydrocarbon. For example, nickel, stainless steel, and de Nora-type dimensionally stable anodes are suitable.

In general, the de Nora-type dimensionally stable anodes are preferred as anode materials in that they are sufficiently stable under reaction conditions so as to eliminate any corrosion problems, particularly under long-term reaction conditions.

The de Nora-type dimensionally stable anodes employ precious metal oxides plated on a titanium substrate. Other materials include, for example, ruthenium oxide mixed with oxides of titanium and tantalum, also plated on a titanium substrate. Dimensionally stable anodes suitable for use in the present process are currently commercially available from the Diamond Shamrock Company, Cleveland, Ohio 44114.

Exemplary of the quaternary ammonium hydroxides which may be employed in the present process are tetraalkylammonium hydroxides such as tetramethylammonium hydroxide, tetraethylammonium hydroxide, tetra-n-propylammmonium hydroxide, tetra-n-butylammonium hydroxide, methyl-tri-n-butylammonium hydroxide, ethyl-tri-n-butylammonium hydroxide, and the like. Of these, tetra-n-butylammonium hydroxide, ethyl-tri-n-butylammonium hydroxide, and tetra-n-propylammonium hydroxide are generally preferred because they maintain the current efficiency at a high level even at increased percent conversion of the aromatic hydrocarbon.

The term "quaternary ammonium" as employed herein has its usual recognized meaning of a cation having four organic groups substituted on the nitrogen.

The reaction time will generally range between about 15 hours and about 30 hours for batch operations. However, it will be recognized that the actual time of reaction is variable and is determined by variables such as the particular aromatic hydrocarbon, the quaternary ammonium hydroxide, concentration of the components in the aqueous emulsive electrolysis medium, percent conversion of the aromatic hydrocarbon to the dihydroaromatic hydrocarbon, volume of the aqueous emulsive electrolysis medium, current density, electrode materials and their surface area and condition, and the like.

The present process is suited to either batch or continuous operations. Continuous operations can involve recirculation of a flowing electrolyte stream, or streams between the electrodes, with continuous or intermittent sampling of the stream for product removal. Unreacted aromatic hydrocarbon can of course be recycled for further reaction. Additional reactants can also be added continuously or intermittently, and other electrolyte components can be augmented, replenished, or removed as appropriate.

It is, of course, apparent to those skilled in the art that the aqueous emulsive electrolysis medium must be a conducting medium to obtain the best flow of current. While media of less than ideal conductivity can be employed, it is preferred from an economic viewpoint not to have too high a resistance. The conductivity can, if desired, be enhanced by the addition of common supporting electrolytes such as electrolyte salts having sufficiently high discharge potentials to the (aqueous phase of the) aqueous emulsive electrolysis medium. In general, however, the aqueous solution of the quaternary ammonium hydroxide in the present process is highly conductive. Thus the addition of a supporting electrolyte to the aqueous emulsive electrolysis medium is not actually necessary. In fact, in most instances the addition of electrolyte salts to the electrolysis medium is neither preferred nor desirable because the electrodes of choice tend to exhibit decreased stability in the presence of such salts. Or conversely stated, the electrodes of choice tend to exhibit increased stability in the absence of such electrolyte salts. And from an economic viewpoint, this increased stability is highly advantageous, particularly in long-term continuous operations.

The term "supporting electrolyte" as employed herein is an electrolyte capable of carrying electric current but not discharging under electrolysis conditions. It will be recognized, of course, that discharge potentials will vary with electrode materials and their surface conditions and various materials in the electrolysis medium.

The term "salt" is employed in its generally recognized sense to indicate a compound composed of a cation and an anion such as produced by the reaction of an acid with a base.

Exemplary of the supporting electrolytes which can be employed to enhance the conductivity of the aqueous emulsive electrolysis medium are quaternary ammonium sulfates, phosphates, perchlorates, and the like such as tetramethylammonium, tetraethylammonium, tetra-n-propylammonium, tetra-n-butylammonium, methyltri-n-butylammonium, and ethyltri-n-butylammonium sulfates, tetramethylammonium, tetraethylammonium, tetra-n-propylammonium, tetra-n-butylammonium, methyltri-n-butylammonium, and ethyltri-n-butylammonium phosphates, and the like.

It will be apparent to those skilled in the art that the pre-formed quaternary ammonium salt can be employed. However, when the quaternary ammonium salt is that which corresponds to the quaternary ammonium hydroxide being employed, which arrangement is preferred, it can either be charged directly—that is, as the pre-formed salt—to the aqueous emulsive electrolysis medium (or more particularly to the aqueous solution of the quaternary ammonium hydroxide), or alternatively, it can be formed in situ by charging an appropriate acid, for example, sulfuric acid, in appropriate amounts to the aqueous solution of quaternary ammonium hydroxide. For example, when tetra-n-butylammonium hydroxide is the quaternary ammonium hydroxide, the charging of sulfuric acid to an aqueous solution thereof produces tetra-n-butylammonium sulfate in situ in an amount equivalent to the amount (gram equivalent weights) of added sulfuric acid.

The concentration of electrolyte salts in the aqueous phase of the aqueous emulsive electrolysis medium, when used, can vary widely, for example, from about 0.5 percent to about 50 percent or more by weight of the aqueous phase of the aqueous emulsive electrolysis medium. Suitable concentrations, however, will often be in the range of about 1.0 percent to about 25 percent, with the percent concentration ratio of the quaternary ammonium hydroxide to the quaternary ammonium salt usually being between about 4:1 and about 1:4.

It will of course be apparent to those skilled in the art that the concentration of the quaternary ammonium salt (when used) is to a certain extent determined by the concentration of the quaternary ammonium hydroxide. That is, if the concentration of the quaternary ammonium hydroxide is fixed at a predetermined value, the percent concentration ratio range will in turn fix the range of concentration of the quaternary ammonium salt. But as noted hereinabove, the employment of such electrolyte salts is not a necessary requirement or, in most instances, even desirable.

The dihydroaromatic hydrocarbon products obtained in the present process can be readily recovered by known procedures. It will be understood, however, that the isolation procedures employed in the procedural Examples and discussed hereinbelow are primarily for illustrative purposes. Other procedures can be employed, and may be preferred, for commercial use.

Upon completion of the reaction, the resultant reaction solution is allowed to stand undisturbed (possibly following a brief period of continued vigorous agitation following completion of the electrolysis) for periods ranging from a few minutes up to about one hour or until two separate and distinct phases—the aqueous phase and the non-aqueous hydrocarbon phase (organic layer)—are formed. If the dihydroaromatic hydrocarbon is a liquid at ambient temperatures, it is separated from the lower aqueous layer as the liquid upper layer together with any remaining unreacted aromatic hydrocarbon. The dihydroaromatic hydrocarbon (organic layer) can be washed with water or dilute mineral acid to remove any traces of base and purified by conventional procedures, for example, fractional distillation at appropriate temperatures and pressures.

Alternatively, if the aromatic hydrocarbon starting material is a solid at ambient temperatures and the dihydroaromatic hydrocarbon is a liquid [for example, naphthalene (solid) and 1,4-dihydronaphthalene (liquid)], substantial portions of any unreacted starting material can be separated from the product by cooling either the entire reaction mixture prior to separating the organic layer (non-aqueous hydrocarbon phase) from the aqueous layer, or the organic layer itself subsequent to separation, to subambient temperatures and filtering to remove solidified aromatic hydrocarbon starting material. The recovered unreacted aromatic hydrocarbon can then be recycled to the electrolysis cell for continued reaction and the dihydroaromatic hydrocarbon purified as described hereinabove.

A further alternative exists if the dihydroaromatic hydrocarbon is a solid at ambient temperatures. Under these circumstances, the dihydroaromatic hydrocarbon, together with any remaining unreacted aromatic hydrocarbon, may be collected by suction filtration, washed with water or dilute mineral acid and dried. Recrystallization, if desired, may be effected from a suitable solvent such as acetic acid, ethanol, and the like.

As noted hereinabove, if the process is a continuous operation, the electrolysis can be continued by recycling the separated lower aqueous layer in admixture with a fresh charge of aromatic hydrocarbon starting material for use as the aqueous emulsive electrolysis medium.

Thus the present invention provides a significant advance in the state of the art by effecting the electrolytic reduction of aromatic hydrocarbons to the corresponding dihydroaromatic hydrocarbons in an undivided cell by employing a greatly simplified aqueous emulsive electrolysis comprising the aromatic hydrocarbon and an aqueous solution of a quaternary ammonium hydroxide.

The following examples illustrate the process of the present invention. They are not to be construed as limitative upon the overall scope thereof.

EXAMPLE 1

The reaction was carried out in an undivided electrolytic cell equipped with a mercury pool cathode (81 square centimeters surface area) and a nickel wire coil anode and comprising a 1-liter jacketed glass reaction vessel consisting of two sections—a bottom section and a shallow top section—joined together by a flange joint and secured by fastening means, such as, for example, metal fastening clamps. The top section had four necks, with standard taper joints, used for attachment of a mechanical stirrer, a glass tube through which ran a copper wire contact for the mercury pool cathode, a copper tube connection for the nickel wire coil anode, a water cooled condenser through which a thermometer was suspended on a nickel wire so as to be partially submerged in the electrolysis medium. The bottom section had a usable volume of greater than 900 milliliters. Vigorous agitation of the electrolysis medium was accomplished with the mechanical stirrer fitted with a large Teflon paddle.

The cell was charged with 500.0 grams (0.48 mole) of 25 percent aqueous tetra-n-butylammonium hydroxide and 100.0 grams (1.3 moles) of benzene. A thermostated liquid (ethylene glycol-water) set at 55° C. was continuously circulated through the jacket. The mixture was vigorously agitated to form an emulsion and electrolyzed at 10 amperes over a 10-hour period. During the electrolysis the temperature of the emulsive mixture stabilized at 66° C. After completion of the electrolysis, stirring was continued an additional 0.5 hour. The mixture was then allowed to stand undisturbed. The organic layer was removed via a pipette to yield 82.2 grams of product mixture. Gas chromatographic analysis of the mixture showed the presence of 1,4-cyclohexadiene, cyclohexene, and unreacted benzene in the percentage ratio of 81:9.5:9.5.

EXAMPLE 2

A 100-milliliter version of the cell described in EXAMPLE 1 was employed except the mercury pool cathode had a surface area of 20 square centimeters and the anode was a coiled 1-foot (30.48-centimeter) length of stainless steel tubing (0.125 inch, 0.32 centimeter, diameter).

The cell was charged with 80.0 grams (0.077 mole) of 25 percent aqueous tetra-n-butylammonium hydroxide and 20.0 grams (0.26 mole) of benzene. The thermostated circulating liquid (ethylene glycol-water) was set at 60° C. and vigorous stirring was commenced. Electrolysis was conducted at 1.0 ampere for 22.5 hours. At the end of the electrolysis period, the mixture was allowed to stand and the organic layer separated via a pipette to yield 14.0 grams of product mixture. Gas chromatographic analysis showed the mixture to be composed of 1,4-cyclohexadiene, cyclohexene, and unreacted benzene in the percentage ratio of 85:7:8.

EXAMPLE 3

The cell described in EXAMPLE 2 above was employed except the anode was a coiled 8-inch (20.32 centimeter) length of stainless steel tubing (0.125 inch, 0.32 centimeter, diameter).

The cell was charged with 80 milliliters of 25 percent aqueous tetra-n-butylammonium hydroxide (0.077 mole) and 20.0 grams (0.22 mole) of toluene. Electrolysis was conducted at 1.0 ampere for 20 hours as described in EXAMPLE 2. At the end of the electrolysis, the mixture was allowed to stand and cool undisturbed and filtered to remove colloidal mercury which had formed during the electrolysis. The organic layer was removed via suction to yield 15.8 grams of product mixture. Gas chromatographic-mass spectroscopic analysis showed the mixture to be composed of 1-methyl-1,4-cyclohexadiene (1,4-dihydrotoluene); 1-, 3-, and 4-methylcyclohexene; and unreacted toluene. The percentage ratio of the components was 74:12:14, respectively. No 3-methyl-1,4-cyclohexadiene (2,5-dihydrotoluene) was detected.

EXAMPLE 4

The cell and procedure described in EXAMPLE 3 above was employed using 20.0 grams (0.19 mole) of p-xylene. The electrolysis was carried out over a 20.5-hour period. Removal of the colloidal mercury and separation of the organic layer yielded 14.25 grams of crude product mixture. The composition of the mixture, as determined by gas chromatographic-mass spectroscopic analysis was as follows: 1,4-dimethyl-1,4-cyclohexadiene (68 percent); 1,4-dimethylcyclohexene and 3,6-dimethylcyclohexene (13 percent, total); and unreacted p-xylene (19 percent).

EXAMPLE 5

The cell described in EXAMPLE 1 was employed except the mercury pool cathode had a surface area of 45 square centimeters, the nickel wire coil anode was replaced with a de Nora-type dimensionally stable anode (56.25 square centimeters surface area), and the Teflon paddle stirrer was replaced with an all glass, one piece propeller-type stirrer.

The cell was charged with 500 milliliters of 10 percent aqueous tetra-n-butylammonium hydroxide (0.2 mole) and 100.0 grams (0.65 mole) of biphenyl. The thermostated ethylene glycol-water solution set at 70° C. was continuously circulated through the jacket. The mixture was vigorously agitated to form an emulsion and electrolyzed at 4 amperes over a 17-hour period. The mixture was thereafter allowed to stand and cool undisturbed. Some of the unreacted biphenyl crystallized and precipitated. The upper organic layer (oil) was removed by suction and cooled to 0° C. (ice/water) to induce crystallization of dissolved unreacted biphenyl which was collected by suction filtration and returned to the cell. The oil (50.0 grams) was set aside.

The cell was charged with an additional 50.0 grams (0.33 mole) of biphenyl and 54 milliliters of water and the electrolysis repeated at 5 amperes. The product (24.0 grams—due to inoperability of the stirrer during a substantial portion of the electrolysis period) was isolated as described above and combined with that from the initial run. The combined oil samples were mixed with 100 milliliters of water and acidified with concentrated hydrochloric acid. The organic layer was separated, dried over anhydrous magnesium sulfate and filtered to yield 74.0 grams of crude product as an oil. The initial two milliliters [fraction (1)] distilled at 65° C. The temperature thereafter drifted down to 55° C., at which temperature a total of 55.7 grams of oil was collected. The oil was redistilled on a spinning band column at 2 millimeters of mercury pressure and 73° C. (pot temperature approximately 115° C.) to yield 36.2 grams of product. The composition of fraction (1) and the final distillate, as determined by gas chromatographic-mass spectroscopic analysis, are shown in TABLE 1.

TABLE 1

RESULTS FROM EXAMPLE 5

| PRODUCT Name | Structure | PERCENTAGE Fraction(1) | Final Distillate |
|---|---|---|---|
| 3-Phenyl-1,4-cyclohexadiene | | 26.42 | 40.87 |
| 3-Phenylcyclohexene | | 32.58[a] | 34.77[a] |
| 4-Phenylcyclohexene | | 26.38 | 21.13 |
| Phenylcyclohexane | | 13.16 | 2.84 |
| ( Cyclohexenyl)-1,4-cyclo-hexadiene[b] | | 0.43 | 0.08 |
| Biphenyl (unreacted) | | 1.03[c] | 0.31[c] |
| Unidentified | | | |

[a]Total percentage for both 3- and 4-phenylcyclohexene, combined.
[b]Tentative, but unconfirmed, identification.
[c]Total percentage for varying amounts of numerous unidentified products, combined.

Four additional runs gave a total yield of approximately 200.0 grams of crude product. The cell voltage during the fourth run had climbed to 22 volts at 5 amperes as opposed to 8 volts in the original run. The increase in cell voltage was due to an off-white coating which formed on the anode surface.

EXAMPLE 6

The cell described in EXAMPLE 5 above was charged with 500 milliliters of 15 percent aqueous tetra-n-butylammonium hydroxide (0.29 mole) and 100.0 grams (0.78 mole) of naphthalene. Electrolysis was conducted as described in EXAMPLE 5 at 4 amperes for 18 hours except the thermostated circulating ethylene glycol-water solution was set at 80° C. Approximately 60.0 grams of crude product was isolated as described in EXAMPLE 5 above. The crude oil was distilled on a spinning band column at 4 millimeters of mercury pressure and 75° C. (pot temperature approximately 125° C.) to collect two fractions: fraction (1) (10.0 grams) and fraction (2) (25.0) grams). The pot residue was emptied into a flask and treated with neutral decolorizing carbon to yield 25.0 grams of material.

The composition of fractions (1) and (2) and the pot residue material was determined by gas chromatographic-mass spectroscopic analysis. The results are shown in TABLE 2 below.

TABLE 2

RESULTS FROM EXAMPLE 6

| PRODUCT Name | Structure | PERCENTAGE Fraction(1) | Fraction(2) | Pot Residue Material |
|---|---|---|---|---|
| 1,4-Dihydronaphthalene | | 35.42 | 52.17 | 42.85 |
| 1,4,5,8-Tetrahydronaphtha-lene (bis-1,4-Cyclohexa-diene) | | 29.60 | 12.21 | 2.15 |
| 1,2,3,4-Tetrahydronaphtha-lene (tetralin)[a] | | 2.06 | 15.76 | 31.05 |

TABLE 2-continued

| RESULTS FROM EXAMPLE 6 | | | | |
|---|---|---|---|---|
| | | | PERCENTAGE | |
| PRODUCT Name | Structure | Fraction(1) | Fraction(2) | Pot Residue Material |
| Naphthalene (unreacted) | 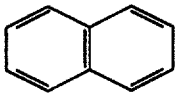 | 4.71 | 15.55 | 22.22 |
| Unidentified[b] | | 28.21 | 4.31 | 1.73 |

[a]Tentative, but unconfirmed, identification.
[b]Total percentage for varying amounts of numerous unidentified products, combined.

The dihydroaromatic hydrocarbons are useful as polymerization chain-transfer agents. Also useful as a chain-transfer agent is 1,4,5,8-tetrahydronaphthalene. It will be apparent that while the overall hydrogen addition to naphthalene indicates this compound to be a tetrahydronaphthalene, it may also be considered to be a bis-1,4-dihydrobenzene or bis-1,4-cyclohexadiene. Viewed from this perspective, it too may be classed as a dihydroaromatic hydrocarbon and within the scope of the present invention—namely, the preparation of dihydroaromatic hydrocarbons.

The dihydroaromatic hydrocarbons in addition to being useful as polymerization chain-transfer agents, are also useful as starting materials for polymers and other organic chemicals.

While the invention has been described with respect to various specific examples and embodiments thereof, it will be understood that the invention is not limited thereto and that many alternatives, modifications, and variations will be apparent to those skilled in the art in light of the foregoing description. According, it is intended to embrace all such alternatives, modifications, and variations as fall within the spirit and broad scope of the invention.

What is claimed is:

1. A process for the preparation of dihydroaromatic hydrocarbons which comprises electrolytic reduction at the cathode in an undivided electrolytic cell by passing a direct electric current through a basic aqueous emulsive electrolysis medium comprising an aromatic hydrocarbon selected from the group consisting of benzene, biphenyl, naphthalene, and alkyl derivatives thereof having 1 to 4 carbon atoms and an aqueous solution of a quaternary ammonium hydroxide to yield the dihydroaromatic hydrocarbon, wherein the electrolytic reduction is conducted in the substantial absence of amine salts.

2. The process of claim 1 wherein the aromatic hydrocarbon is benzene and the dihydroaromatic hydrocarbon is 1,4-cyclohexadiene.

3. The process of claim 1 wherein the quaternary ammonium hydroxide is a tetraalkylammonium hydroxide.

4. A process for the preparation of dihydroaromatic hydrocarbons which comprises electrolytic reduction at the cathode in an undivided electrolytic cell by passing a direct electric current through a basic aqueous emulsive electrolysis medium comprising an aromatic hydrocarbon selected from the group consisting of benzene, biphenyl, naphthalene, and alkyl derivatives thereof having 1 to 4 carbon atoms and an aqueous solution of a quaternary ammonium hydroxide to yield the dihydroaromatic hydrocarbon, wherein the concentration of the quaternary ammonium hydroxide is maintained by removal of carboxylate ions formed in situ in the electrolysis medium and simultaneous replacement by hydroxide ions.

5. The process of claim 4 wherein the carboxylate ions being removed are exchanged for hydroxide ions via alkaline or basic ion exchange.

6. The process of claim 4 wherein the carboxylate ions being removed are replaced by hydroxide ions via electrodialysis.

7. A process for the preparation of dihydroaromatic hydrocarbons which comprises electrolytic reduction at the cathode in an undivided electrolytic cell by passing a direct electric current through a basic aqueous emulsive electrolysis medium comprising an aromatic hydrocarbon selected from the group consisting of benzene, biphenyl, naphthalene, and alkyl derivatives thereof having 1 to 4 carbon atoms and an aqueous solution of a quaternary ammonium hydroxide, in absence of amines or ammonia to yield the dihydroaromatic hydrocarbon, the anode in the cell being of conductive material causing very little reoxidation of dihydroaromatic hydrocarbon, being a de Nora-type dimensionally stable anode, and in which a cathode selected from mercury, zinc, lead or cadmium is used.

8. A process for the preparation of dihydroaromatic hydrocarbons which comprises electrolytic reduction at the cathode in an undivided electrolytic cell by passing a direct electric current through a basic aqueous emulsive electrolysis medium comprising an aromatic hydrocarbon selected from the group consisting of benzenes, biphenyl, naphthalene, and alkyl derivatives thereof having 1 to 4 carbon atoms and an aqueous solution of a quaternary ammonium hydroxide, in absence of amines or ammonia to yield the dihydroaromatic hydrocarbon, the anode in the cell being of conductive material causing very little reoxidation of dihydroaromatic hydrocarbon, being stainless steel.

9. A process for the preparation of dihydroaromatic hydrocarbons which comprises electrolytic reduction at the cathode in an undivided electrolytic cell by passing a direct electric current through a basic aqueous emulsive electrolysis medium comprising an aromatic hydrocarbon selected from the group consisting of benzene, biphenyl, naphthalene, and alkyl derivatives thereof having 1 to 4 carbon atoms and an aqueous solution of a quaternary ammonium hydroxide, in absence of amines or ammonia to yield the dihydroaromatic hydrocarbon, the anode in the cell being of conductive material causing very little reoxidation of dihydroaromatic hydrocarbon, being made of precious metal oxides plated on a titanium substrate.

10. A process for the preparation of dihydroaromatic hydrocarbons which comprises electrolytic reduction at the cathode in an undivided electrolytic cell by passing a direct electric current through a basic aqueous emulsive electrolysis medium comprising an aromatic hydrocarbon selected from the group consisting of benzene, biphenyl, naphthalene, and alkyl derivatives thereof having 1 to 4 carbon atoms and an aqueous solution of a quaternary ammonium hydroxide, in absence of amines or ammonia to yield the dihydroaromatic hydrocarbon, the anode in the cell being of conductive material causing very little reoxidation of dihydroaromatic hydrocarbon, being nickel.

* * * * *